US008388308B2

(12) United States Patent
Karafillis et al.

(10) Patent No.: US 8,388,308 B2
(45) Date of Patent: Mar. 5, 2013

(54) ASYMMETRIC FLOW EXTRACTION SYSTEM

(75) Inventors: Apostolos Pavlos Karafillis, Arlington, MA (US); Kalyanasundaram Muruganathan, Karnataka (IN); Samuel Rulli, Gloucester, MA (US); David Cory Kirk, Memphis, TN (US); Donald Charles Slavik, Cincinnati, OH (US); Erich Alois Krammer, West Chester, OH (US); Manish Kumar, Karnataka (IN)

(73) Assignee: General Electric Company, Schenectady, NY (US)

( * ) Notice: Subject to any disclaimer, the term of this patent is extended or adjusted under 35 U.S.C. 154(b) by 1303 days.

(21) Appl. No.: 11/928,199

(22) Filed: Oct. 30, 2007

(65) Prior Publication Data

US 2009/0297335 A1 Dec. 3, 2009

(51) Int. Cl.
*F01B 25/00* (2006.01)

(52) U.S. Cl. ..... 415/145; 415/169.1

(58) Field of Classification Search ..... 415/144, 415/145, 169.1, 169.4
See application file for complete search history.

(56) References Cited

U.S. PATENT DOCUMENTS

| | | | | |
|---|---|---|---|---|
| 3,632,223 | A | 1/1972 | Hampton | |
| 5,155,993 | A * | 10/1992 | Baughman et al. | 60/226.1 |
| 5,531,565 | A | 7/1996 | Meindl et al. | |
| 6,048,171 | A * | 4/2000 | Donnelly et al. | 415/145 |
| 6,109,868 | A * | 8/2000 | Bulman et al. | 415/144 |
| 6,325,595 | B1 * | 12/2001 | Breeze-Stringfellow et al. | 415/144 |
| 6,442,941 | B1 | 9/2002 | Anand et al. | |
| 6,545,234 | B1 | 4/2003 | Trivette et al. | |
| 6,550,254 | B2 | 4/2003 | Proctor et al. | |
| 6,783,324 | B2 * | 8/2004 | Muny | 415/144 |
| 6,899,513 | B2 * | 5/2005 | Eleftheriou | 415/1 |
| 7,094,020 | B2 | 8/2006 | Dong et al. | |

(Continued)

FOREIGN PATENT DOCUMENTS

| | | | |
|---|---|---|---|
| DE | 4038353 | A1 | 10/1991 |
| EP | 0638725 | A1 | 2/1995 |

(Continued)

OTHER PUBLICATIONS

European Search Report issued in connection with application EP 08166428.6, Mar. 4, 2009.

*Primary Examiner* — Edward Look
*Assistant Examiner* — Aaron R Eastman
(74) *Attorney, Agent, or Firm* — General Electric Company; David J. Clement; Matthew P. Hayden

(57) ABSTRACT

A system for asymmetric flow extraction is described and claimed, the system comprising a flow path, a bleed slot in the flow path, a bleed cavity for receiving at least a portion of the fluid extracted from the flow path and a bleed passage in flow communication with the bleed slot and the bleed cavity wherein the bleed passage has at least one deflector having a shape such that the width of the bleed passage cross section varies in a direction normal to the direction of fluid flow in the bleed passage. In another embodiment, the deflector has an aerodynamic surface having a shape such that the flow passage between the aerodynamic surface and a surface located away from it has a cross sectional shape that is non-axisymmetric. In another embodiment, the bleed passage comprises an assembly of a plurality deflectors, arranged circumferentially.

11 Claims, 6 Drawing Sheets

U.S. PATENT DOCUMENTS

| | | | | |
|---|---|---|---|---|
| 7,704,038 | B2 | 4/2010 | Ring et al. | |
| 7,976,272 | B2 * | 7/2011 | Suciu et al. | 415/126 |
| 2008/0050218 | A1 * | 2/2008 | Sokhey | 415/119 |
| 2008/0115504 | A1 * | 5/2008 | Martensson et al. | 60/785 |
| 2009/0000306 | A1 * | 1/2009 | Damle et al. | 60/785 |

FOREIGN PATENT DOCUMENTS

| | | | |
|---|---|---|---|
| EP | 1136679 | A2 | 9/2001 |
| GB | 2344618 | A | 6/2000 |

* cited by examiner

ASYMMETRIC FLOW EXTRACTION SYSTEM

BACKGROUND OF THE INVENTION

This invention relates generally to fluid flow extraction systems, and more specifically to systems and apparatus for asymmetric bleed flow extraction of fluids from compression systems. As used herein, the term "fluid" includes gases and liquids.

In a gas turbine engine, air is pressurized in a compression module during operation. The air channeled through the compression module is mixed with fuel in a combustor and ignited, generating hot combustion gases which flow through turbine stages that extract energy therefrom for powering the fan and compressor rotors and generate engine thrust to propel an aircraft in flight or to power a load, such as an electrical generator.

The compressor includes a rotor assembly and a stator assembly. The rotor assembly includes a plurality of rotor blades extending radially outward from a disk. More specifically, each rotor blade extends radially between a platform adjacent the disk, to a tip. A gas flowpath through the rotor assembly is bound radially inward by the rotor blade platforms, and radially outward by a plurality of shrouds.

The stator assembly includes a plurality of stator vanes that form nozzles that direct the compressed gas entering the compressor to the rotor blades. The stator vanes extend radially between a root platform and an outer band. The stator assembly is mounted within a compressor casing.

Within at least some known gas turbine engines, a portion of high-pressure air is extracted or bled from the compressor for other uses such as for turbine cooling, pressurizing bearing sumps, purge air or aircraft environment control. The air is bled off from the compressor using bleed slots located over specific portions or stages of the compressor. The extracted air is then supplied to the various locations that need the air via bleed ports located around the outer periphery of the engine.

The mass flow rates of the air that is demanded from the various bleed ports vary significantly, depending on the use for the extracted air. For example, the aircraft environment control system (ECS) demands a significantly larger amount of air flow (up to four times) through the ECS ports than, for example, a turbine blade cooling system through a domestic port. There are multiple bleed ports, supplying air to multiple systems. For example, in an exemplary gas turbine engine shown herein, there is one large ECS bleed port and four smaller domestic bleed ports.

The bleed ports which supply air to the various systems may be of different sizes and may be located non-periodically around the periphery of the engine. The difference of airflow rates between the domestic and ECS ports, in conjunction with the non-periodic placement of the ports circumferentially, causes a circumferential variation of the bleed airflow rate on its extraction point in the compressor flow path. It is desired that the bleed air mass flow rate in the bleed slot entrance in the compressor flow path be as uniform as possible circumferentially. In order to reduce the non- uniformity of flow rate, in conventional designs, the compressed air flows from the bleed cavity into a plenum located on the outside of the compressor. External bleed ports are located on the plenum for supplying compressed air to other locations in the engine, aircraft or other uses. The conventional method of locating the bleed ports on an external plenum located outside the engine increases the engine weight and introduces design complexities. Accordingly, it is desirable to have an asymmetric flow extraction system that facilitates the reduction of flow rate variations at the bleed slot circumferentially without the use of external plenums located outside the engine.

BRIEF DESCRIPTION OF THE INVENTION

The above-mentioned needs may be met by exemplary embodiments which provide a system for asymmetric flow extraction comprising a flow path, a bleed slot in the flow path, a bleed cavity for receiving at least a portion of the fluid extracted from the flow path and a bleed passage in flow communication with the bleed slot and the bleed cavity wherein the bleed passage has at least one deflector having a shape such that the width of the bleed passage cross section varies in a direction normal to the direction of fluid flow in the bleed passage. In another embodiment, the deflector has an aerodynamic surface having a shape such that the flow passage between the aerodynamic surface and a surface located away from it has a cross sectional shape that is non-axisymmetric. In another embodiment, the bleed passage comprises an assembly of a plurality deflectors, arranged circumferentially.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
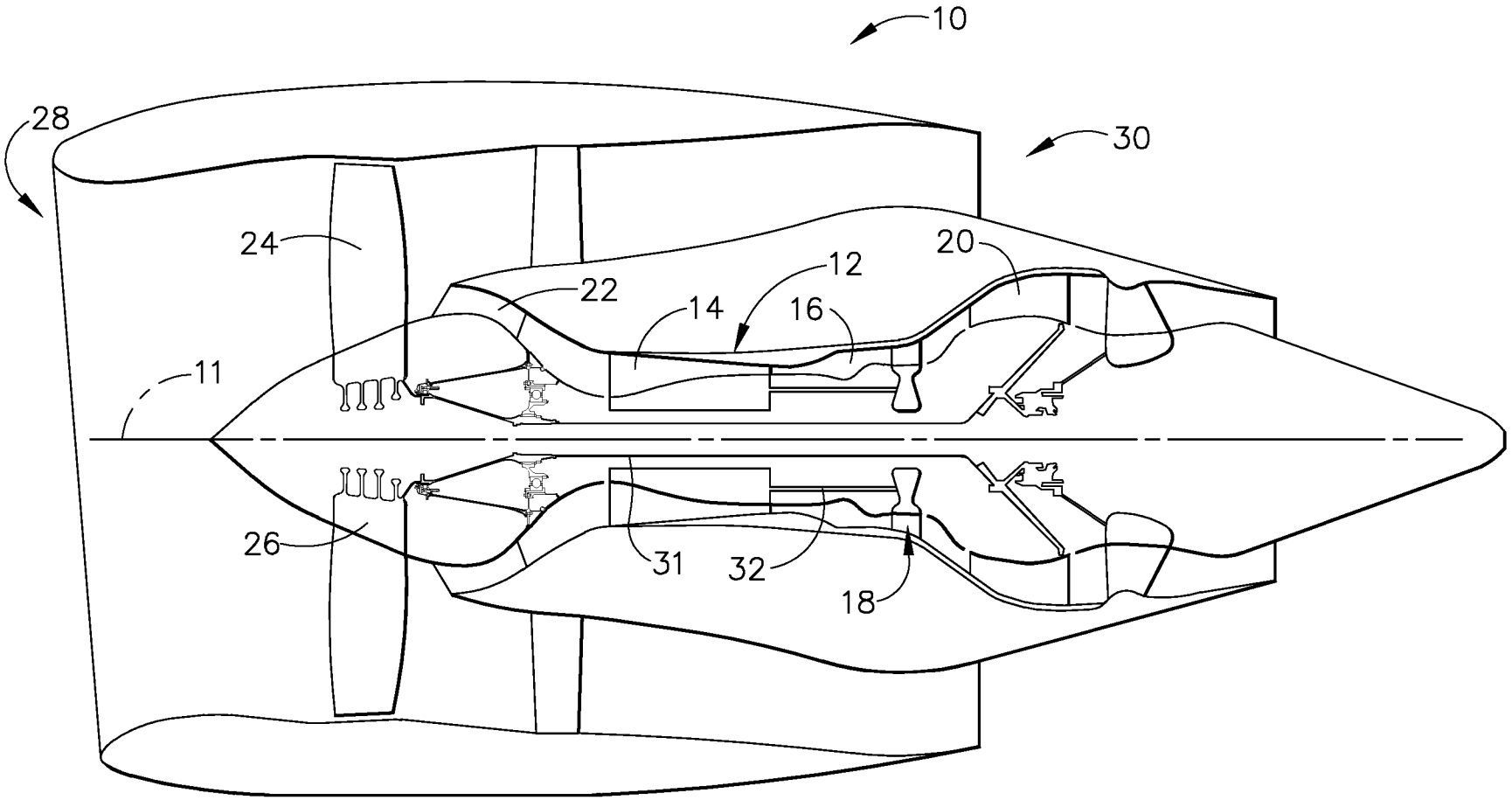
FIG. 1 is a cross-sectional view of an exemplary gas turbine engine assembly.

Referring to the drawings wherein identical reference numerals denote the same elements throughout the various views, FIG. 1 shows a cross-sectional view of a gas turbine engine assembly 10 having a longitudinal axis 11. The gas turbine engine assembly 10 includes a core gas turbine engine 12 that includes a high-pressure compressor 14, a combustor 16, and a high-pressure turbine 18. In the exemplary embodiment shown in FIG. 1, the gas turbine engine assembly 10 also includes a low-pressure turbine 20 that is coupled axially downstream from core gas turbine engine 12, and a fan assembly 22 that is coupled axially upstream from core gas turbine engine 12. Fan assembly 22 includes an array of fan blades 24 that extend radially outward from a rotor disk 26. In the exemplary embodiment shown in FIG. 1, engine 10 has an intake side 28 and an exhaust side 30. In the exemplary embodiment, gas turbine engine assembly 10 is a turbofan gas turbine engine that is available from General Electric Company, Cincinnati, Ohio. Core gas turbine engine 12, fan assembly 22, and low-pressure turbine 20 are coupled together by a first rotor shaft 31, and compressor 14 and high-pressure turbine 18 are coupled together by a second rotor shaft 32.

In operation, air flows through fan assembly blades 24 and compressed air is supplied to high pressure compressor 14. The air discharged from fan assembly 22 is channeled to compressor 14 wherein the airflow is further compressed and channeled to combustor 16. Products of combustion from combustor 16 are utilized to drive turbines 18 and 20, and turbine 20 drives fan assembly 22 via shaft 31. Engine 10 is operable at a range of operating conditions between design operating conditions and off-design operating conditions.

Figure 2:
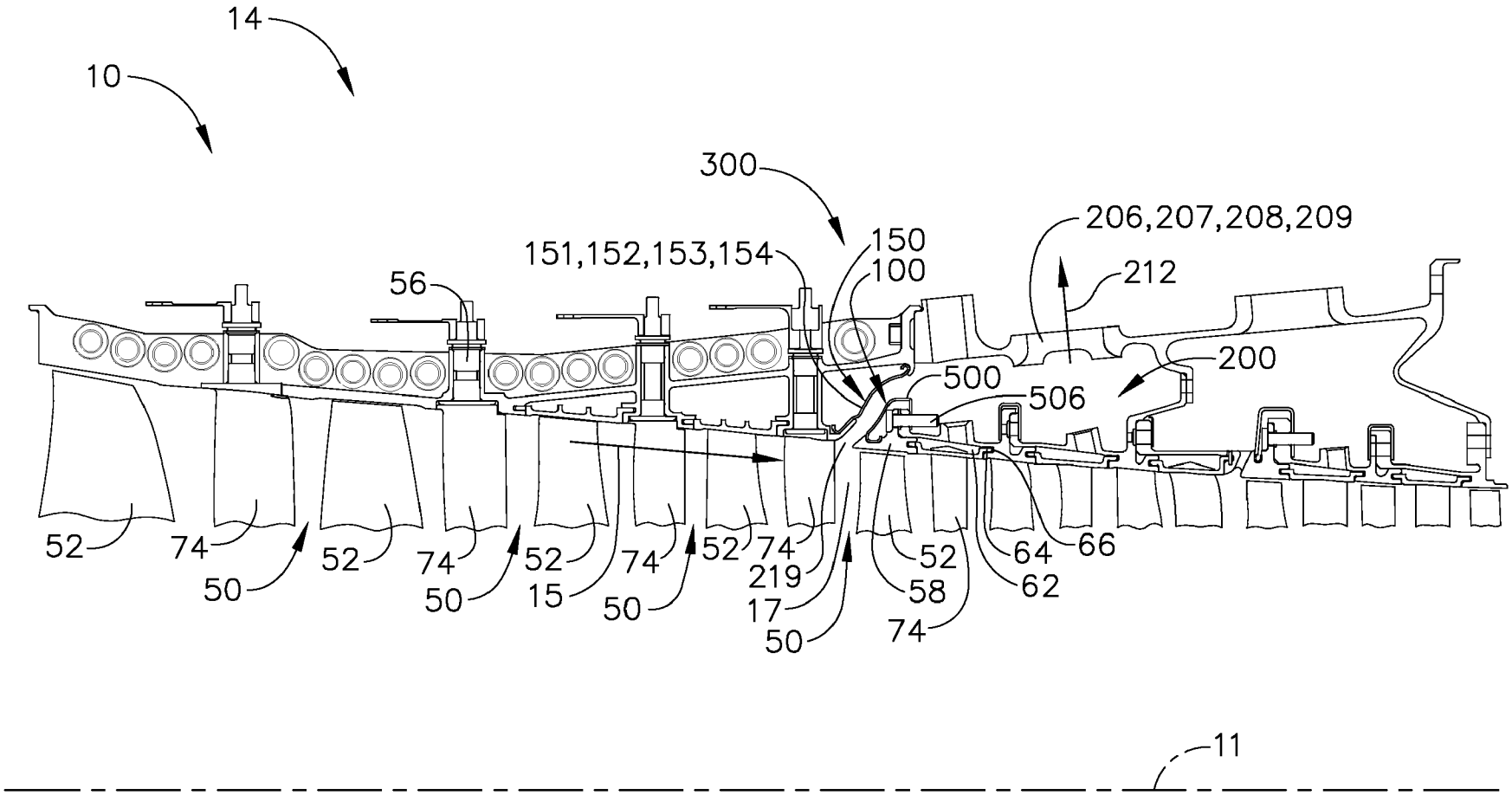
FIG. 2 is an axial cross-sectional view of a portion of a high pressure compressor with an exemplary embodiment of the asymmetric flow extraction system.

FIG. 2 is an axial cross-sectional view of a portion of a high pressure compressor 14 with an exemplary embodiment of an asymmetric flow extraction system 300 including a bleed slot 219 in the flow path 17 in the form of an annular opening and a bleed flow passage 100. The compressor 14 includes a plurality of stages 50 wherein each stage 50 includes a row of circumferentially spaced rotor blades 52 and a row of stator vane assemblies 56. The stator vane assembly 56 includes a row of circumferentially spaced stator vanes 74. Rotor blades 52 are typically supported by rotor disks 26, and are coupled to rotor shaft 32. Compressor 14 is surrounded by a casing 62 that supports stator vane assemblies 56. In the exemplary design shown in FIG. 2, a portion of the compressed air from the flow path 17 enters the bleed passage 100 through the bleed slot 219 and enters a bleed cavity 200.

FIG. 2 shows an exemplary embodiment of the bleed flow passage 100 having an exemplary embodiment of a deflector assembly 150 comprising a plurality of deflectors, 151, 152, 153, 154, arranged in the circumferential direction. In the exemplary embodiments shown in FIG. 2, casing 62 forms a portion of a compressor flow path 17 extending through compressor 14. Casing 62 has rails 64 extending axially upstream and downstream of casing 62. To create a continuous compressor flow path, rails 64 are coupled to slots 66 defined in adjacent stator bodies 58. In the exemplary embodiment, the compressor stator body 58 includes a shield assembly 500 to facilitate reducing convection and aerodynamic bleed losses.

Figure 3:
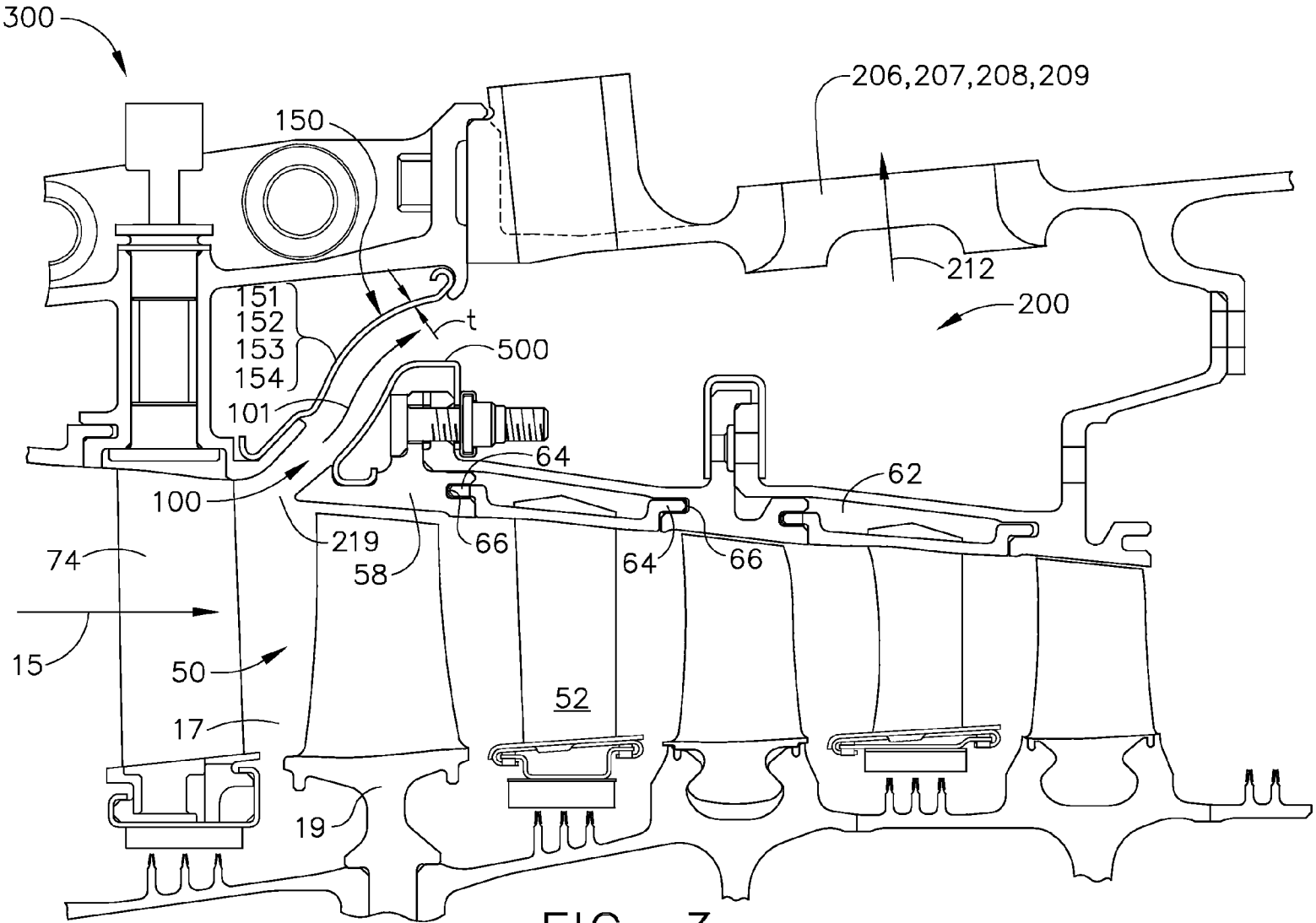
FIG. 3 is an enlarged view of an exemplary embodiment of the asymmetric flow extraction system.

FIG. 3 shows an enlarged view of an exemplary asymmetric flow extraction system shown in FIG. 2. The exemplary asymmetric flow extraction system 300 comprises a compressor flow path 17, through which the compressed air flows in the general direction shown as item 15. A bleed slot 219 is located in the flow path for extracting some of the air that is flowing through the flow path. The bleed slot 219 is generally annular in shape, but other configurations such as, for example, shaped holes located circumferentially around flow path surface can be used. A bleed passage 100 is constructed between the bleed slot 219 and a bleed cavity 200 located on the outer side of compressor casing 62. The air entering the bleed slot 219 is directed through the bleed passage 100 into the bleed cavity 200. The bleed passage flow area is designed such that the air flow is diffused as the air flows from the bleed slot into the bleed cavity in order to recover some of the pressure losses associated with the extraction.

Figure 4:
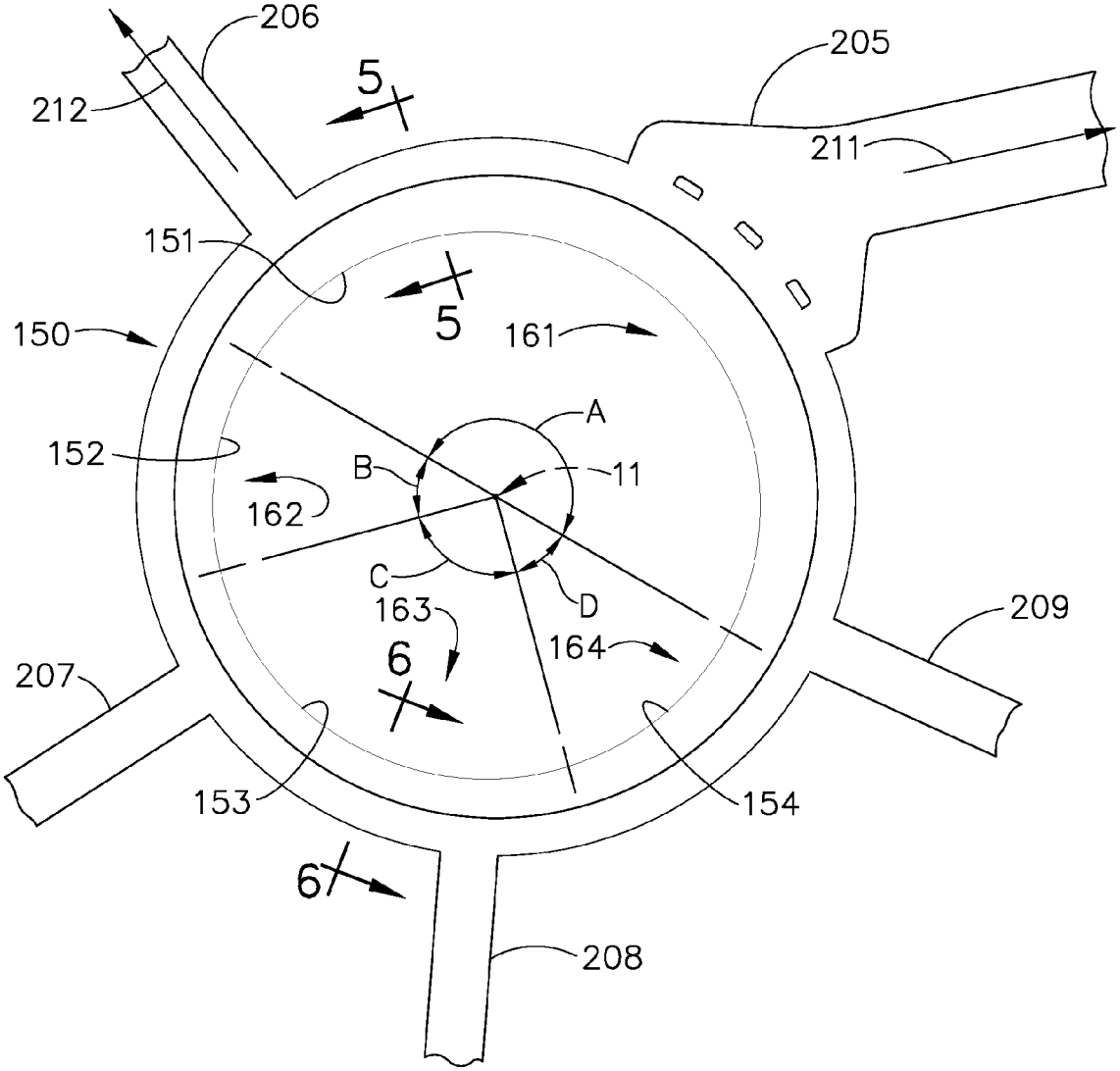
FIG. 4 is an axial view (aft looking forward) of an exemplary embodiment of the asymmetric flow extraction system.

Bleed ports, such as for example shown in FIG. 3 and FIG. 4 as items 205, 206, 207, 208 and 209, are located in flow communication with the bleed cavity 200. As shown in an exemplary embodiment in FIG. 4, the bleed ports 205, 206, 207, 208 and 209 may be located asymmetrically around the outside of the compressor. These bleed ports supply air to different parts of the engine 10, such as for cooling turbine components, or to the aircraft environment control system (ECS). The size of these bleed ports and the rate of airflow through each of these bleed ports may be different from one another. For example, the flow rate in the ECS bleed port 205 may be four times higher than through the cooling air bleed port 206.

Figure 6:
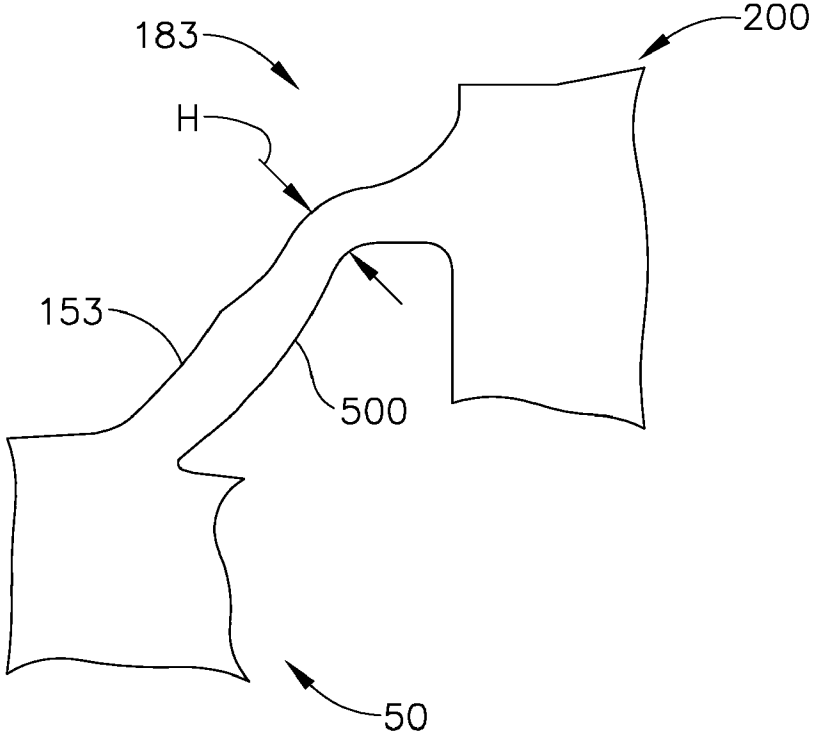
FIG. 6 is a cross-sectional view of the bleed flow passage at section B-B in FIG. 4.
Figure 5:
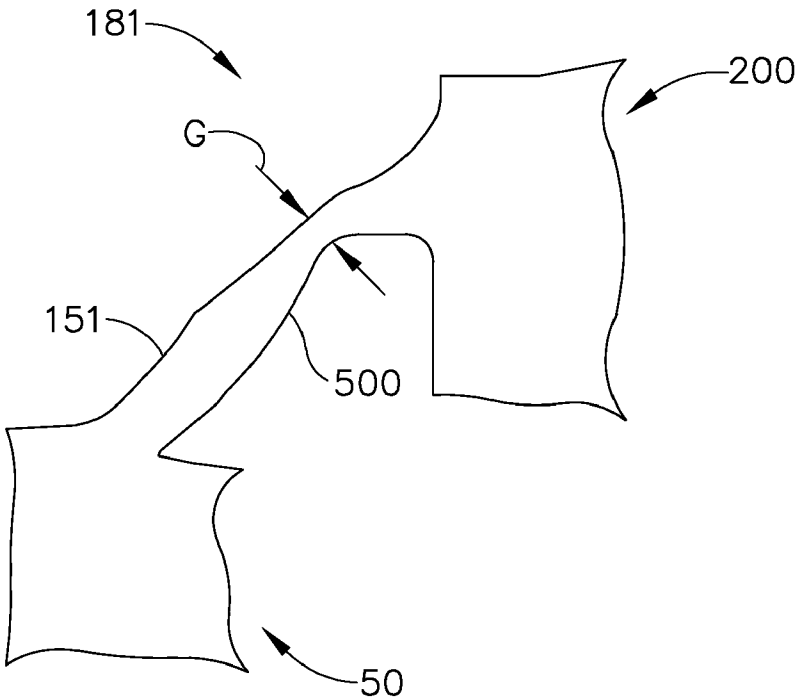
FIG. 5 is a cross-sectional view of the bleed flow passage at section A-A in FIG. 4.

In the exemplary embodiments shown in FIGS. 4, 5 and 6, the deflector geometry and the bleed flow passage 100 are configured such that the mechanical or aerodynamic effects of the non-uniform flow rates through asymmetrically located bleed ports such as 205, 206, 207, 208 and 209 at the bleed port entrance 219 and the flow path 50 are reduced. This is accomplished, for example, by circumferentially varying the flow cross section width of the flow passage 100 such that the flow passage width is narrower in the region of large flow extraction such as by the ECS bleed port 205 (see FIG. 4) and wider in the region of small flow extraction such as by a cooling bleed port 208 (see FIG. 4).

The variation of the flow cross section width of the flow passage 100 in the circumferential direction is accomplished using a deflector assembly, such as the one shown as item 150 in FIGS. 4, 5 and 6. In the exemplary embodiment shown in FIG. 4, the deflector assembly 150 comprises four sectors, 161, 162, 163 and 164 arranged circumferentially. Each of these sectors comprises a deflector such as item 151, 152, 153 and 154 in FIG. 4 having a curved or arched shape referred to herein as an arcuate deflector. In the exemplary embodiment shown in FIG. 4, the deflector 151 is shaped such that the width "G" (See FIG. 5) of the flow passage 100 is constant and the deflector 153 is shaped such that the width "H" (See FIG. 6) of the flow passage is also a constant. In the exemplary embodiment shown in FIG. 4, the deflector 151 which creates a narrower width "G" (see FIG. 5) is located in a circumferential region adjacent to the region in the bleed cavity 200 where large flow demand bleed ports, such as the ECS bleed port 205, are located. Also, in the exemplary embodiment shown in FIG. 4, the deflector 153 which creates a wider width "H" (see FIG. 6) is located in a circumferential region adjacent to the region in the bleed cavity 200 where smaller flow demand bleed ports, such as the bleed port 208, are located. Transition deflectors 152 and 154 are circumferentially located between the deflectors 151 and 153. The transition deflectors 152 and 154 are shaped such that the width of the flow passage 100 changes smoothly in the circumferential direction from the smaller width ("G") in sector 161 to the larger width ("H") in sector 163 and from the larger width to the smaller width in sector 164.

Figure 7:
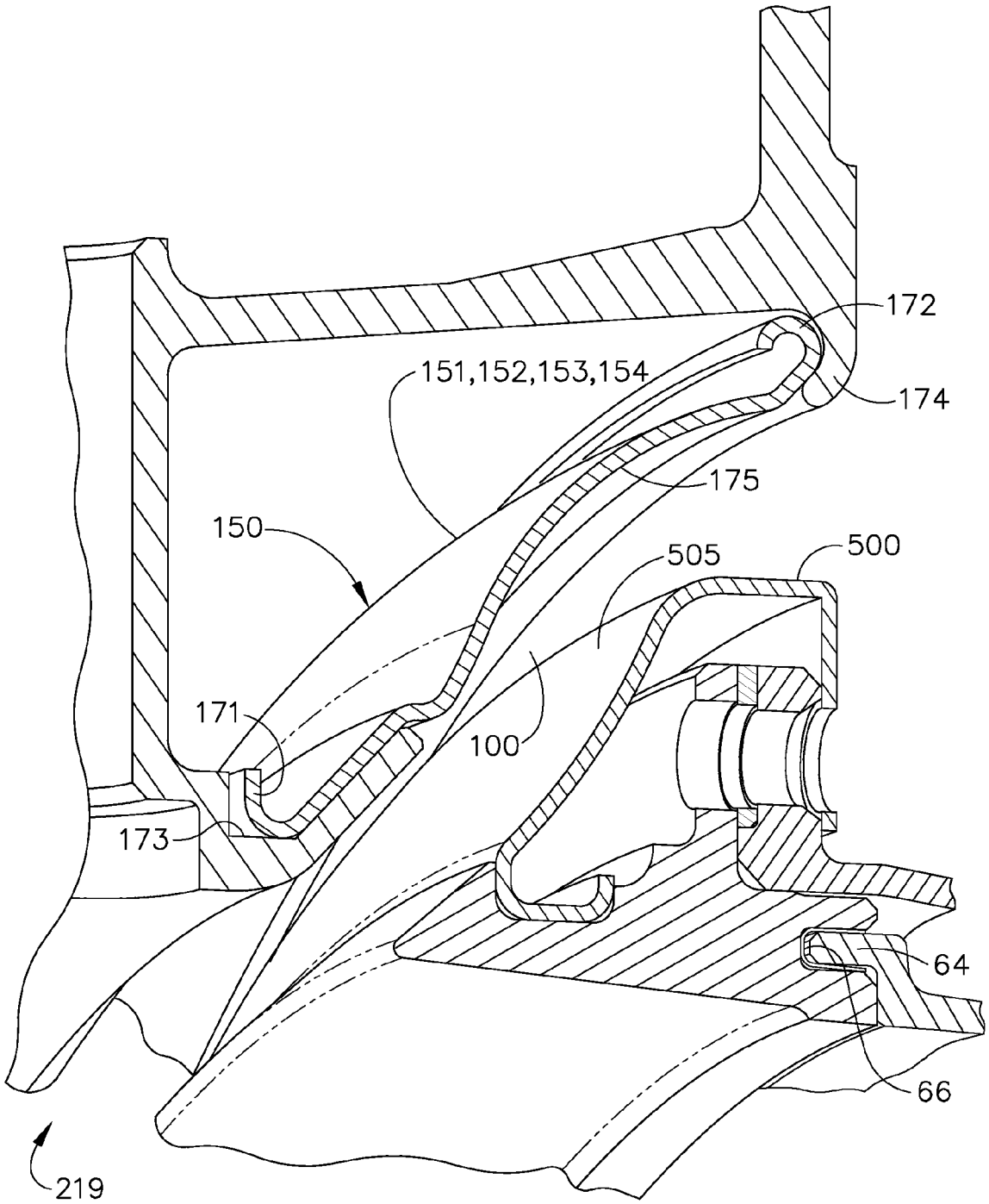
FIG. 7 is a perspective view of the bleed flow passage showing a portion of the deflector assembly.

FIG. 7 is a perspective view of the bleed flow passage 100, showing a portion of the deflector assembly 150. An exemplary deflector 151 for forming the bleed passage 100 is shown. The deflector has a forward end 171, an aft end 172, and an aerodynamic surface 175 between the forward end 171 and the aft end 172 that is shaped such that the bleed passage 100 between the aerodynamic surface 175 and a surface 505 located away from it has a cross sectional shape that is non-axisymmetric. The deflector is held in position by the forward end 171 and aft end 172 which fit within corresponding slots 173, 174 in the casing. Alternatively, the deflector may be held in position using conventional fasteners or other suitable means.

In an exemplary embodiment of the asymmetric flow extraction system (Refer to FIG. 4), the sector angle "A" is 180 degrees, sector angle "B" is 45 degrees, sector angle "C" is 90 degrees, and sector angle "D" is 45 degrees. The width "G" is 0.15 inches and width "H" is 0.25 inches. The deflectors 151, 152, 153 and 154 are approximately 0.030 thick and are made from Inconel 718. For this embodiment, the bleed slot pressure recovery from a bleed port at the Stage 4 compressor location increases by approximately 1%. The flow rate variation in the circumferential direction at the bleed slot is approximately 30%, which is consistent with conventional systems using external plenums.

In an alternative embodiment of the present invention, the deflector may be made in a single piece such that the circumferential variations in the flow passage width as described above is accomplished by designing the aerodynamic shape of the deflector to incorporate the variations described above for each of the sectors 161, 162, 163 and 164. In another alternative embodiment of the present invention, the variations of the flow passage width in the circumferential direction as described above is accomplished by designing the aerodynamic shape of the shield assembly 500, using the teachings herein.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

What is claimed is:

1. A system for asymmetric flow extraction comprising:

a flow path for flowing a fluid there-through;

a bleed slot in the flow path for extracting a portion of the fluid from the flow path;

a bleed cavity for receiving at least a portion of the fluid extracted from the flow path;

a bleed passage in flow communication with the bleed slot and the bleed cavity;

wherein the bleed passage has at least one deflector having a shape such that the width of the bleed passage cross section varies in a direction normal to the direction of fluid flow in the bleed passage; and, wherein the bleed cavity is in flow communication with a plurality of bleed ports located asymmetrically in the circumferential direction and in which said bleed ports remove the fluid from the bleed cavity.

2. A system according to claim 1 wherein the bleed passage comprises a plurality of flow sectors in the circumferential direction.

3. A system according to claim 2 wherein the plurality of flow sectors is formed by a plurality of deflectors arranged circumferentially.

4. A system according to claim 1 wherein the bleed passage comprises a first flow sector having a first width, a second flow sector having a second width, and at least one transitional flow sector located circumferentially between the first flow sector and the second flow sector.

5. A system according to claim 1 wherein the bleed passage comprises a plurality of arcuate deflectors arranged circumferentially.

6. A system according to claim 1 wherein the at least one deflector has an aerodynamic shape such that variation of the flow rate at the bleed slot in the circumferential direction is reduced.

7. A system according to claim 1 wherein the bleed passage has a portion wherein the fluid extracted from the flow path is diffused.

8. A system according to claim 1 wherein the bleed cavity is in flow communication with a means for removing the fluid from the bleed cavity.

9. A deflector assembly for forming a bleed passage comprising:

a first sector having a first aerodynamic surface such that the flow passage between the first aerodynamic surface and a surface located away from it has a first cross sectional shape that does not change in the circumferential direction;

a second sector having a second aerodynamic surface such that the flow passage between the second aerodynamic surface and a surface located away from it has a second cross sectional shape that does not change in the circumferential direction;

a third sector having a third aerodynamic surface such that the flow passage between the third aerodynamic surface and a surface located away from it has a cross sectional shape that varies from the first cross sectional shape to the second cross sectional shape in the circumferential direction; and a fourth sector having a fourth aerodynamic surface such that the flow passage between the fourth aerodynamic surface and a surface located away from it has a cross sectional shape that varies from the second cross sectional shape to the first cross sectional shape in the circumferential direction.

10. A deflector assembly according to claim 9 wherein the first cross sectional shape has a smaller area than the second cross sectional shape

11. A deflector assembly according to claim 10 wherein the first sector is located in circumferential proximity to a bleed port that extracts a larger amount of bleed flow.

* * * * *